US007744077B2

(12) United States Patent
Buxton et al.

(10) Patent No.: US 7,744,077 B2
(45) Date of Patent: Jun. 29, 2010

(54) JAM-DOOR OPEN SENSING USING MEDIA SENSOR AND METHOD FOR USE THEREOF

(75) Inventors: Patrick A. Buxton, Lexington, KY (US); Kevin M. Johnson, Georgetown, KY (US); Michael W. Lawrence, Lexington, KY (US); Mahesan Chelvayohan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1511 days.

(21) Appl. No.: 10/933,761

(22) Filed: Sep. 3, 2004

(65) Prior Publication Data

US 2006/0049571 A1 Mar. 9, 2006

(51) Int. Cl.
*B65H 5/22* (2006.01)

(52) U.S. Cl. ..... 271/3.17; 399/124; 358/498

(58) Field of Classification Search ..... 358/498, 358/474, 471, 400, 496; 257/215, 213; 271/3.17; 399/124

See application file for complete search history.

(56) References Cited

U.S. PATENT DOCUMENTS 5,192,141 A 3/1993 Chung et al.
5,291,256 A 3/1994 Kitajima et al.
5,323,180 A 6/1994 Kuberka et al.
5,365,322 A 11/1994 Hamada et al.
5,678,123 A 10/1997 Kim
5,678,138 A 10/1997 Kobayashi et al.
5,787,326 A 7/1998 Ogawa et al.
5,971,388 A * 10/1999 Hattori et al. ..... 271/10.03
6,356,293 B1 3/2002 Chiba
6,409,167 B1 6/2002 Bohn
6,433,329 B1 * 8/2002 Butka et al. ..... 250/221
6,539,185 B2 3/2003 Hanyu et al.
6,628,903 B1 9/2003 Ohori et al.
6,698,951 B2 3/2004 Kitai et al.
2004/0056086 A1 * 3/2004 Mason et al. ..... 235/379

* cited by examiner

*Primary Examiner*—Cheukfan Lee
(74) *Attorney, Agent, or Firm*—John Victor Pezdek

(57) ABSTRACT

An open jam-door sensor having a peripheral device such as a printer including a substantially C-shaped feed path, the C-shaped feed path defining an inner guide and an outer guide, the outer guide being connected to the peripheral device. A media sensor for detecting type of media in the device is disposed on one of said guide opposite a reflective portion disposed on the other of said guides. The media sensor also being used to detect when the outer guide is in an open position and causing a processor to inhibit device operations, such as printing.

28 Claims, 11 Drawing Sheets

JAM-DOOR OPEN SENSING USING MEDIA SENSOR AND METHOD FOR USE THEREOF

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTINGS, ETC.

None.

BACKGROUND

1. Field of the Invention

The present invention provides a sensor for a media feed path. More specifically, the present invention provides a sensor which detects a type of media in a feed path and further detects when a jam-door is open.

2. Description of the Related Art

It has been previously suggested to utilize an L-path media feed system for stand-alone printers and multi-functions devices. In L-path media feed systems, the input media is positioned at the rear of the device in a nearly vertical orientation. The L-path media feed system further comprises a substantially horizontal output tray and a printing zone defined between the input tray and the output tray. The media is moved through a feed path from the near vertical orientation to a substantially horizontal orientation. Thus when viewed from a side, the media moves through a substantially L-shaped path.

However, L-path paper feeds have several shortcomings. First, L-path paper feed devices have a large height dimension because of the input tray extending upwardly from the peripheral to support input media. Thus, placement of the device on a shelf or cabinet may be difficult. In addition, paper loading may also be problematic when the unit is placed within the shelf or cabinet because the media generally extends above the input tray. Second, the media extends above the input tray and is visible to those around the machine, which is generally not aesthetically pleasing to many users. Finally, L-path paper feeds are prone to multi-sheet feed problems because of the orientation of the input media. More specifically, the input media is continuously forced downward into a pick area by gravity due to the nearly vertical orientation of the media. As a result of the continuous force on the input media, friction bucklers are utilized to inhibit movement of more than one sheet of media from the input tray to a feed area. However, the friction bucklers may mark and/or bend the media in addition to being an added expense to manufacturers and consumer. These problems in combination have led some to a change from utilization of an L-path media feed system to a C-path media feed system.

In general, C-path media feed systems overcome these problems. A C-path paper feed utilizes a substantially horizontally disposed input tray adjacent a substantially horizontally disposed output tray. Typically, the input tray is positioned beneath the output tray and, as such, is also known as a bottom loading device. The feed path is generally curved from the input tray to the output tray in order to move the media through a print zone and from a side resembles a substantially C-shaped path. Due to the construction of the C-path media feed, the height of the peripheral or printer is decreased. In other words, the device lacks the large upwardly extending media tray. Further, the media is generally hidden from view within the interior of the printer or multi-function device. Finally, with the input tray oriented horizontally, the C-path feed device does not have the multi-sheet feed gravity effects typically associated with L-path media feeds. Consequently, multi-feeds are less likely to occur and friction bucklers are not required. Along the C-path device is a media sensor to sense the type of media being moved through the device.

Since implementing the C-path media feed, an additional unforeseen problem has developed. C-path media path devices must include a means for clearing a media jams within the peripheral device. Typically, a jam-door is positioned in the rear portion of the printer or peripheral to provide access to the feed path and a means for clearing the media jam. However when such a jam-door is opened, media will not feed properly for printing. Further, a user may be exposed to moving parts such as gears and rollers in the area of the jam-door. In order to overcome such a problem, an additional electrical circuit has been used to notify a print processor that the jam-door is disposed in an open condition. However, an additional circuit adds complexity and cost to such printing devices and further may result in additional opportunity for product malfunction, all of which are undesirable.

Given the foregoing deficiencies, it will be appreciated that an apparatus is needed which senses media as well as sensing when the jam-door is open and inhibiting operation of a printer or printer portion of a multi-function peripheral when a jam-door is opened so that media will not incorrectly feed and further so that users will not be exposed to moving parts during such an attempted operation.

SUMMARY OF THE INVENTION

In summary, a media sensing and an open jam-door sensor is implemented in a peripheral device having a substantially C-shaped feed path wherein the C-shaped feed path defined by an inner guide and an outer guide. The outer guide is connected to the peripheral device. A media sensor is pivotally connected to a sensor arm and the sensor arm is rotatable with a sensor arm shaft connected to a pick motor such that the sensor is moveable with respect to the sensor arm and the sensor arm shaft and the C-shaped feed path. The media sensing and open jam-door sensor is situated within a peripheral device housing and connected to one of the two guides and a jam-door is connected to the housing. The outer guide is defined by the jam-door. A reflective portion is disposed opposite said media sensor. The sensor emits a signal that is reflected either by the reflective portion or, if present, by the media in the feed path. The reflective portion may be defined by a reflective sticker or a surface of the guide that is opposite to the media sensor. The peripheral device further comprises a processor which is signaled by the media sensor when the outer-guide (i.e. the jam door) is opened or when media type is sensed. A media input tray is provided at an input side of the substantially C-shaped feed path.

Further, a method of detecting an open jam-door comprises the steps of rotating a pick motor in at least one direction, moving a media sensor toward one of the inner guide and the outer guide or toward the feed path with the pick motor rotation, emitting a light from the media sensor at the other of the guides and detecting the light intensity, and determining whether the light intensity is within a preselected intensity range indicating that the jam-door is closed. Another embodiment of the method further comprises determining a differential between the detected media sensor light intensity and a second light intensity in order to determine whether the jam-door is closed. A second intensity of light is detected without emitting a light from the media sensor and a differential between the detected media sensor light intensity and the second detected light intensity is determined. The method further comprises the step of determining if the differential signal is within a preselected range indicating that the jam-door is closed. The method further comprises rotating the pick motor in another direction in order to rotate the sensor away from the inner guide or the feed path. Alternatively, the method can comprise emitting a single sensor light and determining whether the jam door is open based on whether the light is received or not received.

BRIEF DESCRIPTION OF THE DRAWINGS

FIG. 9 is a side view of the C-path media feed of FIG. 5 depicting the jam-door in a closed position and media passing there through;

DETAILED DESCRIPTION

Referring now in detail to the drawings, wherein like numerals indicate like elements throughout the several views, there are shown in FIGS. 1-10 various aspects of a media sensor for sensing an open jam-door. The media sensor serves two functions: first, the media sensor detects a type of media moving through a feed path within a printer or multi-function peripheral and second, the media sensor detects when a jam-door is disposed in an open position.

Figure 1:
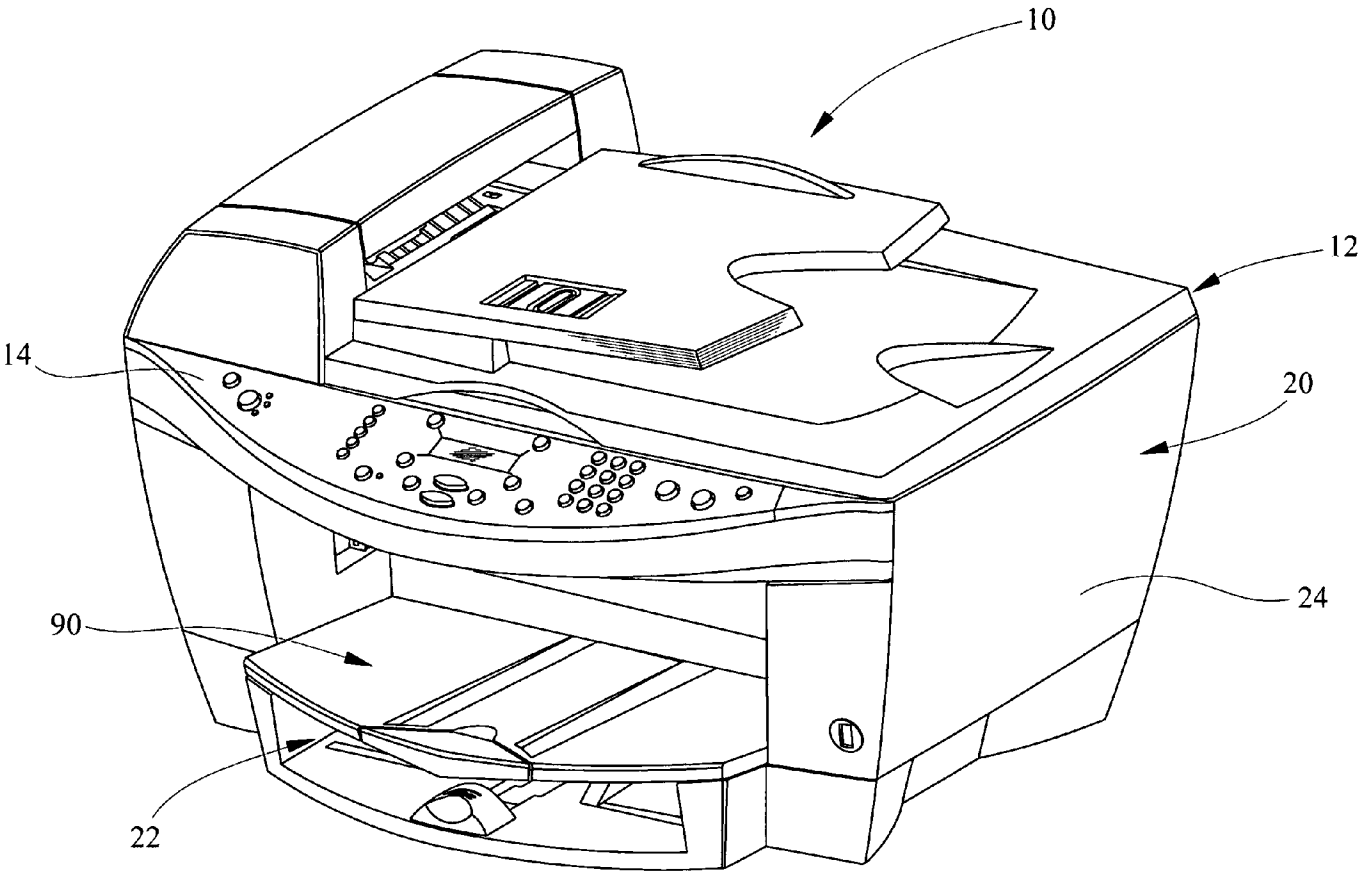
FIG. 1 is a perspective view of an illustrative image forming apparatus including a C-path media feed system.

Referring initially to FIG. 1, a multi-function peripheral device 10 is shown having a scanner portion 12 and an image forming apparatus or printer 20 included therewith. Upon reading of the present disclosure, it should be understood by one skilled in the art that the present invention may be alternatively utilized with a stand alone printer. The printing portion 20 may be defined by a laser printer, a thermal inkjet printer, a piezo inkjet printer, or other image forming technology. The printer or image forming apparatus 20 may include a C-path feed system as generally indicated by the media input tray 22 and the media output tray 90 disposed above the input tray 22. The peripheral 10 further comprises a housing 24 from which the input tray 22 and output tray 90 may extend. The input tray 22 and output tray 90 may comprise multiple configurations but at least may include a lower support surface for receiving and supporting a plurality of media sheets. The multifunction peripheral device 10 may also comprise a control panel 14 including a plurality of buttons and a display providing various notifications, menus, and selection options.

Referring still to FIG. 1, the scanner portion 12 generally includes an input tray and output tray for auto-document feed scanners and may also comprise a platen for manual scanning of target media. The scanner portion 12 is generally disposed on an upper portion of the peripheral device 10 above the printing portion 20 although alternate configurations may be utilized. The scanner portion 12 is shown including a scanner lid hingedly attached along the rear edge of the housing 24. The lid may be moved with respect to a scanner bed between a closed position shown in FIGS. 1 and 2 and an open position (not shown) revealing a transparent platen. Within the scanning portion 12 is an optical scanning unit having a plurality of parts which are not shown but generally described herein. The scanning unit comprises a scanning motor and drive which connects the scanning motor and a scar bar which is driven bi-directionally along a scanning axis defined as the longer dimension of the scanner bed. The scan bar may include a lamp, an image sensor, a lens and at least one mirror therein for obtaining a scanned image from a document. The scan bar may be an optical reduction scanner or a contact image sensor (CIS). At least one guide bar may be disposed within the scanner bed and extending in the direction of the scanning axis to guide the scanning unit along the scanning axis. The scan bar moves within the scanner bed beneath the platen and the lamp illuminates the document positioned on the platen. For optical reduction scanners, mirrors and lenses located within the scan bar direct the image reflected from the document to the image sensor. The image sensor then determines the image and sends data representing the image to onboard memory, a network drive, or a PC or server housing a hard disk drive or an optical disc drive such as a CD-R, CD-RW, or DVD-R/RW. As is known in the art, a similar process occurs with the CIS-type of image sensor. Alternatively, the original document may be scanned by the optical scanning component and a copy printed from the printing component 20 such as with a multi-function peripheral.

Figure 2:
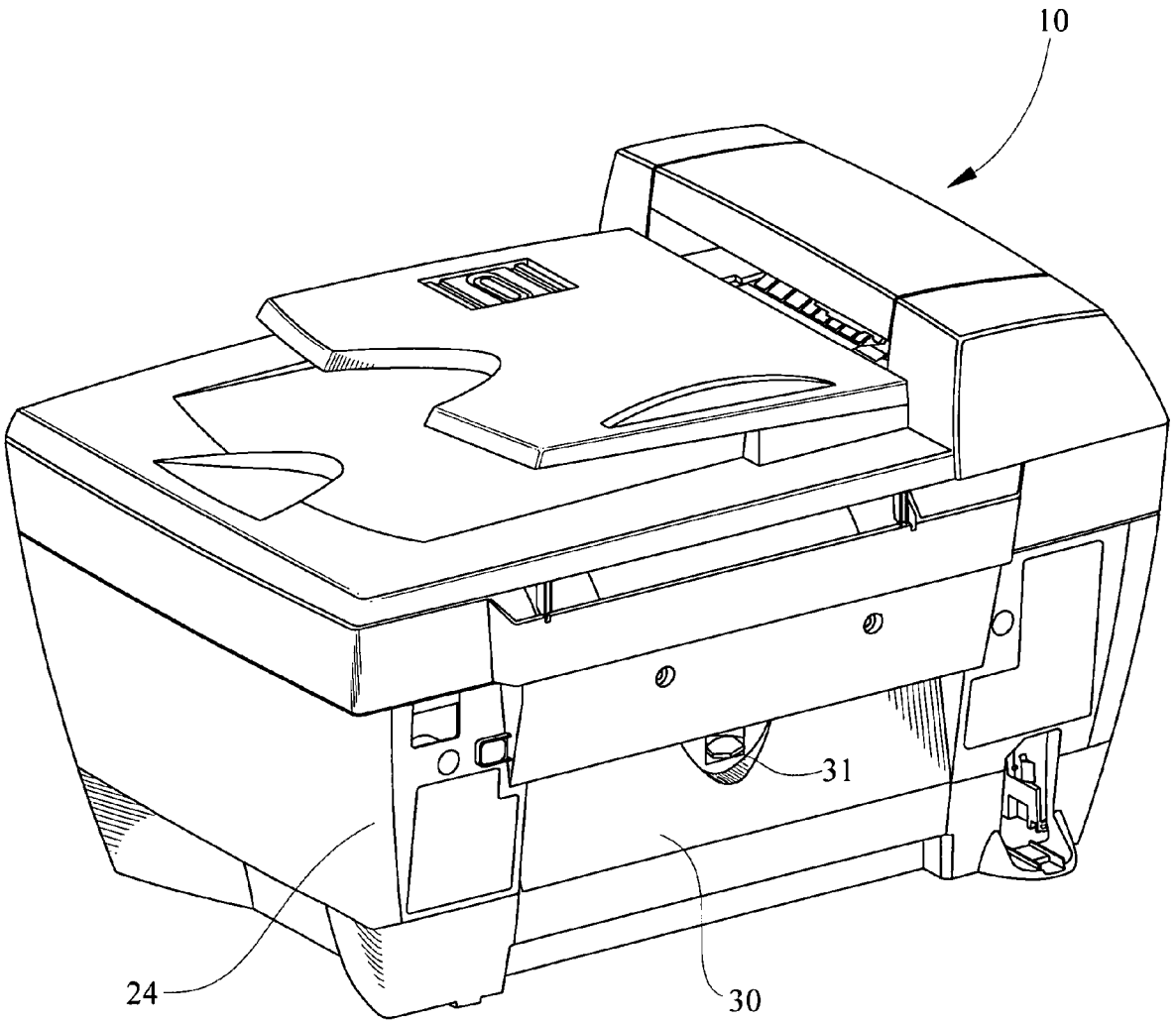
FIG. 2 is a rear perspective view of the image forming apparatus of FIG. 1.

Referring now to FIG. 2, a rear perspective view of the multi-function peripheral device 10 is shown. Defining a rear surface along the rear portion of the housing 24 is a jam-door 30. The jam-door 30 may be rotated between a closed position, as shown in FIG. 2, and an open position, shown in FIGS. 6 and 7. The jam-door 30 further comprises a finger tab 31 which engages a portion of the housing 24 to releasably close or open the jam-door 30. Alternatively, various other release devices may be utilized in order to retain the jam-door 30 in a closed position or release the jam-door 30 to an open position. Extending from an inner surface of the jam-door 30 is an outer guide 34 (FIG. 3) discussed hereinafter.

Figure 3:
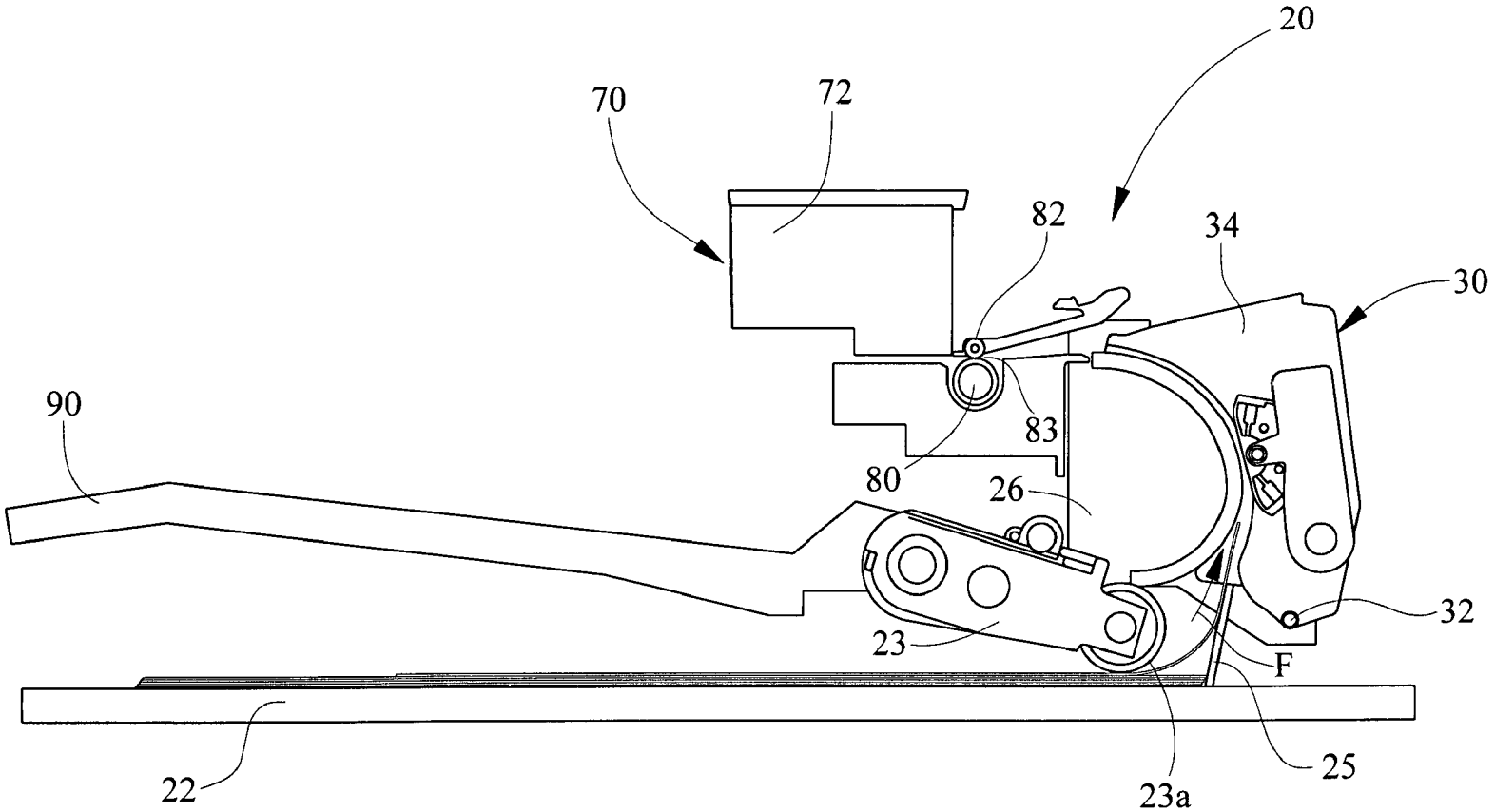
FIG. 3 is a side view of the C-path media feed of the image forming apparatus of FIG. 1.

Referring now to FIG. 3, a side view of the printer portion 20 is shown with the housing 24 removed revealing a feed path F being substantially C-shaped and extending between the input tray 22 and an output tray 90. At a lower area of the printer portion 20, an input tray 22 is depicted having a plurality of input media sheets thereon. At an inner or rearward portion of the input tray 22 is a media dam 25 extending upwardly from the input tray 22 and defining an obtuse angle therewith. The media dam 25 provides positive feedback to a user that the stack of media is fully inserted into the input tray 22 so that the user does not over force the media into the paper tray 22. Such over forcing of media may lead to paper jams. The media dam 25 also functions to guide the media sheets upward into a feed path F. The feed path F is substantially C-shaped and extends between the input tray 22 and an output tray 90. Depending downwardly from above the input tray 22 and engaging the media sheets is an auto-compensating mechanism 23 being driven by a pick motor (not shown). The auto-compensating mechanism 23 includes a pick tire 23*a* which rotates in a pick direction when the pick motor is rotated in a first direction and engages the media sheets within the input tray 22 for advancement of the sheet media into the feed path F. As torque is applied through the auto-compensating mechanism 23 by the pick motor, the auto-compensating mechanism 23 and pick tire 23*a* may rotate toward or away from the media sheets in the tray 22 depending on the direction of rotation of the pick motor. For example, when the pick motor rotates in a first direction, the auto-compensating mechanism 23 pivots from an upper position, shown, to a lower position to index media from the input tray 22 into feed path F through the printer portion 20. When the pick motor rotates in a second or reverse direction, the auto-compensating mechanism 23 is lifted from engagement with the input media. Alternatively, the auto-compensating mechanism 23 be in continuous contact with the media and utilize a clutch to allow the pick tire 23*a* to freely rotate in one direction. According to this embodiment, the pick tire 23*a* may be driven by a first rotation of the pick motor in a feeding direction, while a second or reverse rotation of the pick motor may disengage the clutch allowing the pick tire 23*a* to freely rotate with the media passing therebelow.

Positioned adjacent an upper portion of the feed path F is a feed roller 80. The feed roller 80 may be rotated by a gear mechanism (not shown) or other drive system which transfers torque from a motor to the feed roller 80. Disposed above the feed roller 80 is a feed idler 82 which together define a feed nip 83. The feed nip 83 receives media from the feed path F and feeds the media to a print zone 70 within the peripheral 10. After feeding through the print zone 70, the media sheets are fed to the output tray 90. As depicted in FIG. 1, the output tray 90 extends from the housing 24. The output tray 90 may comprise at least a lower surface for supporting a plurality of media sheets received from the print zone 70.

As previously indicated, between the upper portion of feed path F and the exit tray 90 is a print zone 70. For purpose of clarity of this description, an inkjet printing mechanism is shown throughout the Figures, however one of ordinary skill in the art may recognize that various image forming technologies may be utilized. As depicted in FIG. 3, the print zone 70 includes a print cartridge 72 which translates along a path substantially transverse to the feed path F, (i.e., into and out of the page as shown). As the media passes beneath the cartridge 70, ink droplets are selectively ejected by heat, pressure or sound pulses onto the media passing below.

Figure 4:
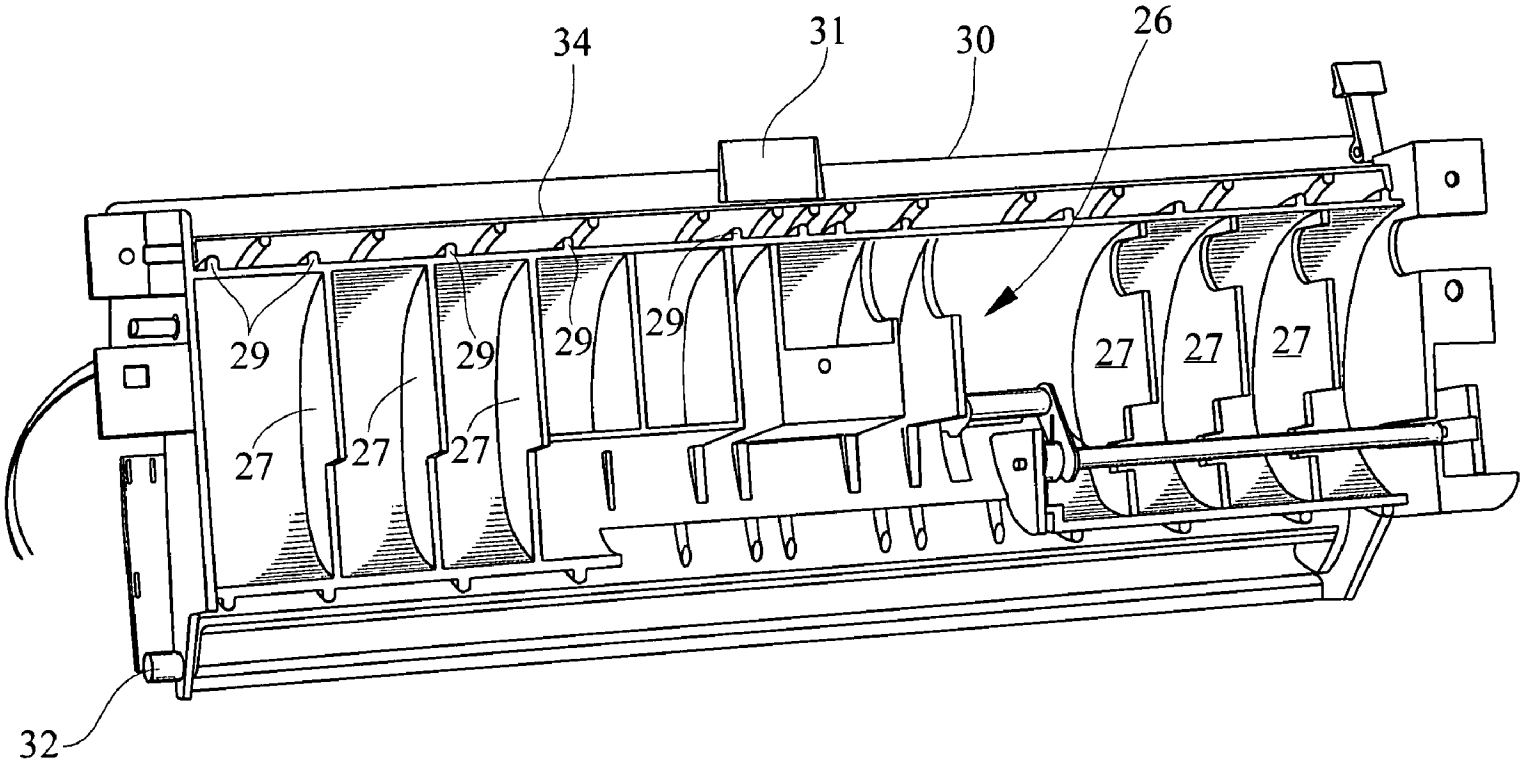
FIG. 4 is a front perspective view of the jam-door and inner feed path portion in a closed position.
Figure 5:
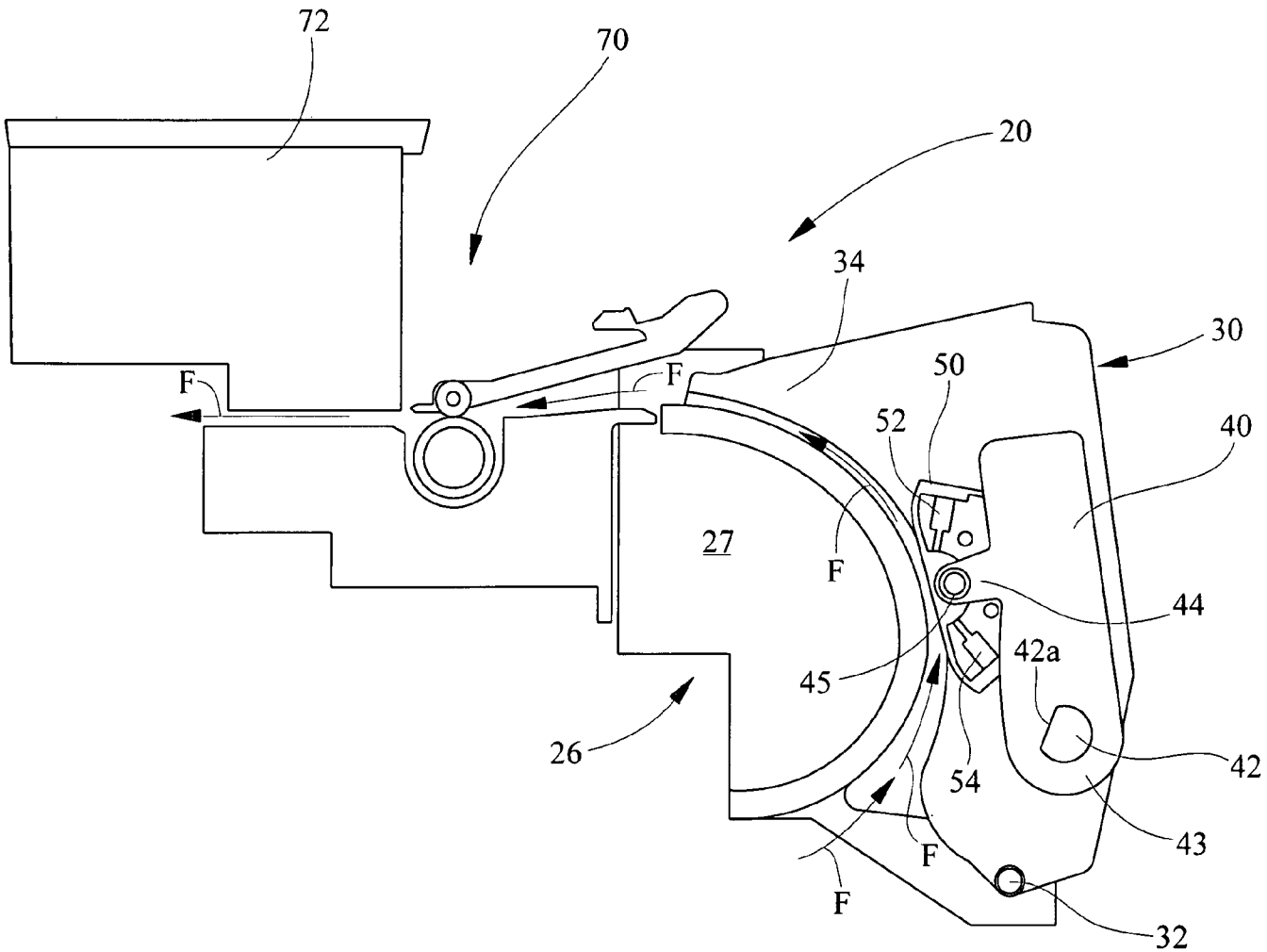
FIG. 5 is a side view of the C-path media feed of FIG. 4 depicting the jam-door in an closed position.

Referring now to FIGS. 3-5, the feed path F is defined between an inner guide or inner feed path portion 26 and an outer guide or outer feed path portion 34. The inner guide 26 and outer guide 34 function to direct media from the input tray 22 to the print zone 70 and on to the output tray 90. According to the exemplary embodiment, the outer guide 34 defines an inner portion of the jam-door 30 and is pivotally connected to the peripheral device 10. The inner guide 26 may be formed of a plurality of materials including but not limited to, for example, low-cost molded polymeric materials. Alternatively, other materials may be utilized preferably comprising a low coefficient of friction. In either embodiment, the inner guide 26 may be substantially white in color or some other reflective color which reflects light from a sensor at a preselected intensity and may be received by a detector or receiver. The inner guide 26 is substantially semi-circular in shape along one side including an inner feed path surface 28 (FIG. 6) of a low coefficient of friction opposite the jam-door 30. The inner guide 26 may have a plurality of supports 27 on an innermost surface opposite the media path F for strengthening the inner guide 26 while reducing weight and manufacturing cost. On the inner feed path surface 28 of the inner guide 26 adjacent the feed path F are a plurality of ribs 29. The ribs 29 retain media in alignment during feeding through the feed path F. The ribs 29 also reduce surface contact between the media passing through the feed path F and the inner surface 28. This reduces drag force on the media which may lead to skewing of the media. The ribs 29 further inhibit contact with any reflective stickers or imperfections in the inner surface 28 which may interfere with media feeding through the feed path.

Referring now to FIGS. 1-5, the jam-door 30 is pivotally connected at pivot 32 to the housing 24 of the multi-function peripheral 10. Although the jam-door 30 is pivotally connected to the housing 24, it should be apparent that the jam-door 30 may be connected to a plurality of structures including the peripheral frame or other internal structure. As depicted in FIGS. 2-3, the jam-door 30 is depicted in a closed position essential for proper media feed and printing. The jam-door 30 includes an outer guide 34 opposite the inner guide 26. The jam-door 30 and outer guide 34 may be formed of a plurality of materials having a low coefficient of friction including, for example, a low-cost molded polymeric material. Together the inner guide 26 and outer guide 34 define the feed path F extending between the input tray 22 and the print zone 70. At a lower portion of the feed path F is an opening for receiving media from the input tray 22. In order to reduce jams when starting the media from the input tray 22 into the feed path F, the lower portion of the feed path F may be wider than the upper portion in the transition area from the input tray 22 to the feed path F. The jam-door 30 may comprise a plurality of shapes depending on the design of the housing 24.

Figure 6:
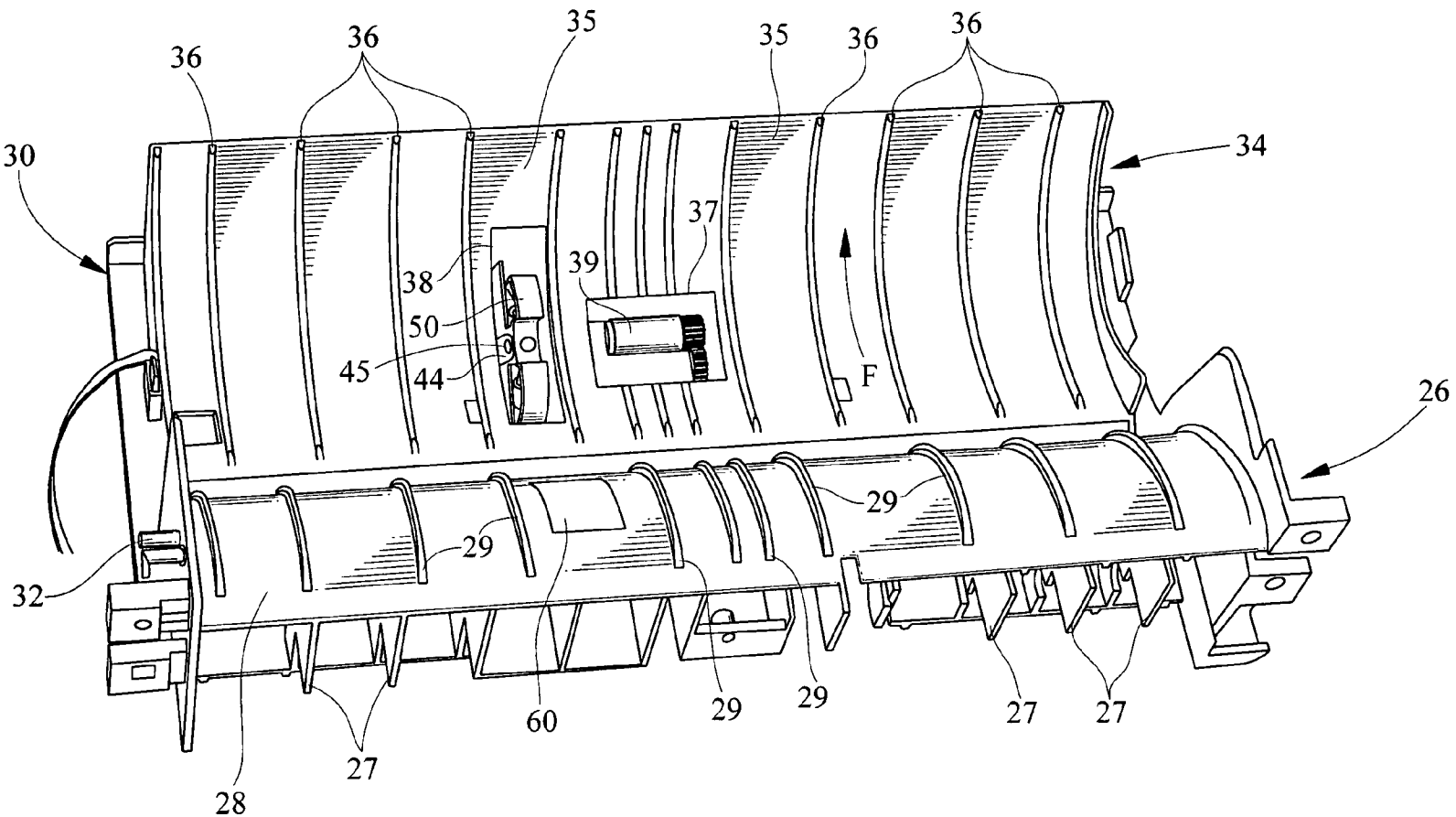
FIG. 6 is a front perspective view of the jam-door and inner feed path portion in an open position.

Referring now to FIG. 6, a front perspective view of the outer guide 34 and inner guide 26 is shown wherein the outer guide 34 is open and rotated away from the inner guide 26. As shown, a plurality of outer guide ribs 36 extend from the innermost surfaces 35 of outer guide 34. The ribs 36 cooperate with the ribs 29 to reduce surface contact between the media and feed path F during feeding thus reducing drag and possible media skewing. The ribs 36 also inhibit unintended contact between the media and the sensor 50 or a second auto-compensating mechanism and pick tire 39. Within the outer guide surface 35 are two apertures. A first aperture 37 defines a window or passage for the second auto-compensating mechanism including pick tire 39 to move through and aid advancement of media through the feed path F. More specifically, the second auto-compensating mechanism and pick tire 39 are mounted on a sensor arm shaft 42 (FIG. 5) and therefore rotate with the shaft 42 through the window 37 when the pick motor is reversed or moves in a second direction. When the pick motor (not shown) is rotated in a first direction, the second auto-compensating mechanism moves away from the feed path F. Thus, as one of ordinary skill in the art will realize the first auto-compensating mechanism 23 and second auto-compensating mechanism 39 function oppositely with rotation of the pick motor. A second aperture 38 defines a window or passage for a sensor 50 described further hereinafter.

Referring now to FIGS. 5-6, extending through the jam-door 30 is the sensor shaft 42 which may be connected by a gear mechanism (not shown) to a pick motor (not shown). A sensor arm 40 may be substantially trapezoidal in shape having a rounded lower end 43 extending about the sensor arm shaft 42; however various shapes may be utilized.

Figure 8:
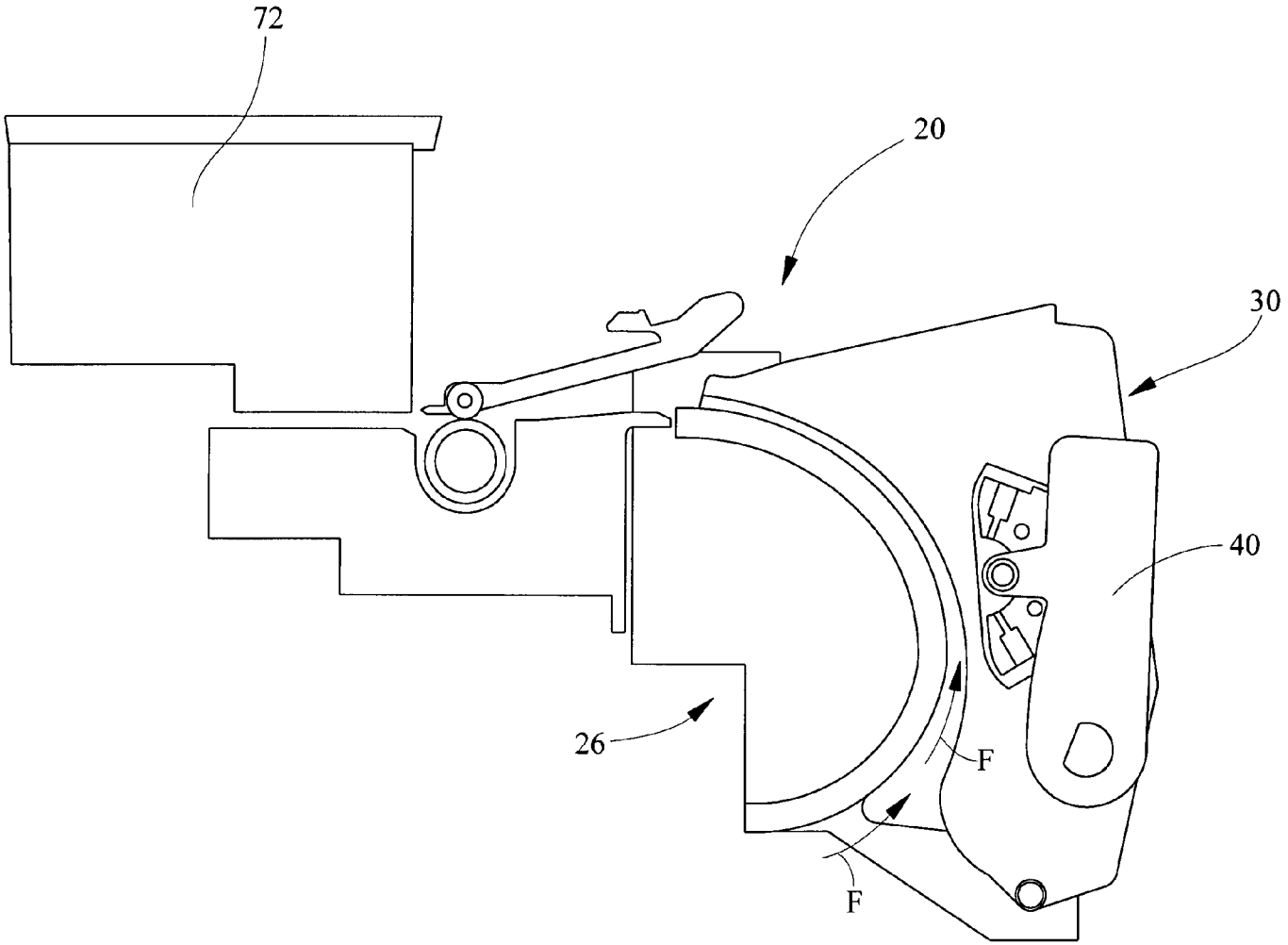
FIG. 8 is a side view of the image forming apparatus of the present invention with the jam-door closed and the sensor rotated away from the feed path.

The sensor arm shaft 42 may employ various means to transmit rotation of the arm shaft 42 to the sensor arm 40 including, for example, a milled or flat portion 42*a*, or a pin extending through the sensor arm 40 and shaft 42 in order to transmit torque to the sensor arm 40. The sensor arm 40 further comprises a finger 44 extending therefrom for connection of the sensor 50 to the sensor arm 40. When the pick motor rotates in a second or reverse direction transmitting torque through the sensor arm shaft 42, the sensor arm 40 engaging the sensor arm shaft 42 rotates through the window 38 toward the feed path F. As a result, the sensor 50 also rotates toward the feed path F. When the pick motor rotates in a first direction, the sensor 50 and sensor arm 40 rotate away from the feed path F, as best shown in FIG. 8.

Figure 9:
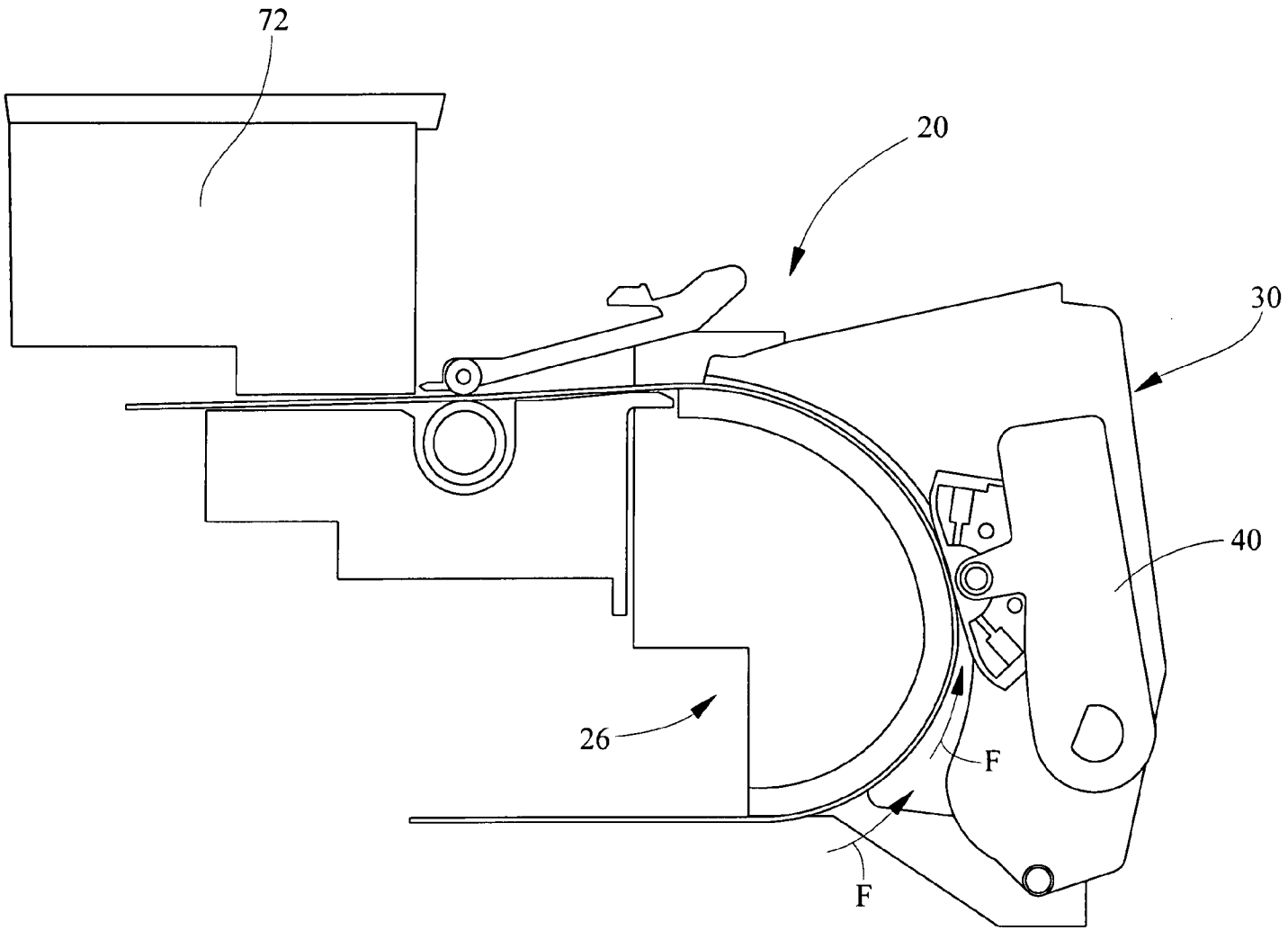

Still referring to FIGS. 5-6, fastened to the sensor arm 40 is the sensor 50 having two functions. First, the sensor 50 detects a media type passing through the feed path F. Second, the sensor 50 determines if the jam-door 30 is in an open or closed position. Since the sensor 50 performs these two functions, it is important that the sensor 50 be properly positioned and oriented relative to the media and inner guide 26. The sensor 50 is pivotally connected to the sensor arm 40 at the finger 44 by, for instance, a fastener 45, screw, bolt, rivet, or other connection. According to the present illustrative embodiment the sensor 50 pivots about the sensor arm shaft 42 and therefore moves relative to the inner guide 26 when the jam-door 30 opens since the sensor arm 40 moves with the jam-door 30. In addition, the sensor 50 can pivot at the finger 44 through a pre-selected angular distance. Because the sensor 50 pivots with the sensor arm 40 about the sensor arm shaft 42, as well as pivoting between the fingers 44 of the sensor arm 40, the sensor 50 has dual pivoting function which optimizes engagement of the sensor 50 with the media passing through feed path F and with the inner guide 26. With only single pivot about the sensor arm shaft 42, the sensor 50 may not be properly oriented relative to the media or the inner guide 26 in order to receive a reflected signal. Alternatively, if the sensor 50 only pivoted between the fingers 44, the sensor 50 may not be positioned close enough to the media or inner guide 26 to obtain any reflected signal. Thus, the movement of the sensor 50 with the sensor arm 40 provides positioning of the sensor 50 proximate the media or inner guide 26 while the pivoting of the sensor 50 between the fingers 44 allows proper orientation of the sensor 50 relative to the media and inner guide 26 for sending and receiving reflected light of a preselected intensity. As the sensor 50 moves with rotation of the sensor arm shaft 42, the sensor 50 moves within the outer guide 34 and through window 38 to engage the media or inner guide 26 as shown in FIGS. 5 and 9. Alternatively, when the arm 40 rotates in an opposite direction, the sensor 50 moves away from the media and inner guide 26 through the window 38 to the position shown in FIG. 8.

Still referring to FIGS. 5-6, the sensor 50 includes a light emitting diode or LED source 52 shown at an upper portion of the sensor 50 and a detector 54 which receives the reflected LED light from the source 52, shown at the lower portion of sensor 50. Alternatively, it is well within the scope of the present embodiment that the source 52 be located at the bottom of the sensor 50 and the detector disposed at an upper portion of the sensor 50. The LED source 52 emits a signal such as a light at a preselected intensity onto a media passing through the feed path F. Based on the type of media passing through the feed path F, the light is reflected and received by the detector 54 at a different intensity. The sensor 50 creates a signal of a specific voltage depending on the reflected intensity received at the detector 54 and sends the voltage to a processor within the peripheral 10. The processor correlates the specific voltage signal to a media type and formats the print job according to the media type determined. Such formatting may include, for example, the shingling pattern of ink disposed on the media and/or an amount of ink expelled from the cartridge. The media passing through the feed path F may be, for example, coated paper, plain paper, photo paper, or a transparency, arranged from least to most reflective. During operation, it may be necessary that the sensor 50 contact the media passing through the feed path F in order to obtain a proper reading. Accordingly, dual pivoting at finger 44 and about sensor arm shaft 42 may provide optimal placement with respect to the media. However, contact between the sensor 50 and media or inner guide 26 may not be necessary.

Figure 7:
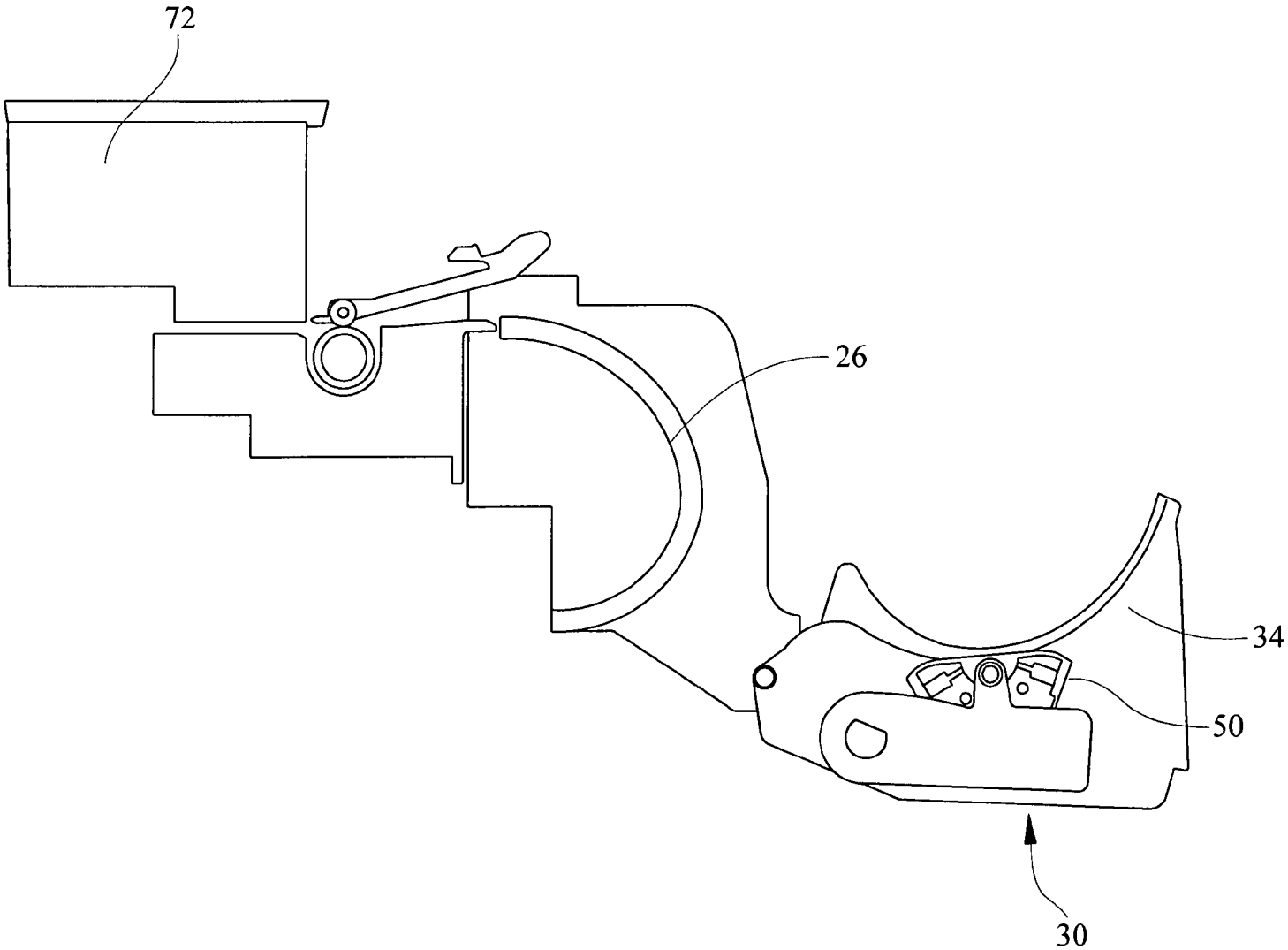
FIG. 7 is a side view of the image forming apparatus of FIG. 6 depicting the C-path media feed including a jam-door in an open position.

Still referring to FIGS. 5-6, in addition to detecting the media type, the sensor 50 also functions to determine when the jam-door 30 is in an open condition. As previously indicated, the inner surface 28 (FIG. 6) of the inner guide 26 may be formed of a reflective material which reflects light from the source 52 to the detector 54. Alternatively, the inner surface 28 may be made reflective by a reflective sticker, a reflective coating or the like 60 disposed on the inner surface 28 opposite the sensor 50. In either embodiment, the inner guide surface 28 or, for example, reflective sticker 60 is in optical communication with the sensor 50 in order to determine when the jam-door 30 is disposed in an open or closed position by detecting whether the reflected light intensity is within a preselected range. The sensor 50 is rotated toward or in contact with the inner guide surface 28 and the LED source 52 emits a light toward the reflective surface 28 or the sticker 60. When the jam-door 30 is in a closed position the light is reflected and received by the detector 54 within an intensity range or a differential range as described hereinafter. However, when the jam-door 30 is disposed in an open position, as shown in FIGS. 6-7, the detector 54 will not receive the light reflected from the reflective surface 28 or sticker 60. Thus, the processor is signaled that the jam-door 30 is disposed in an open position.

Figure 10:
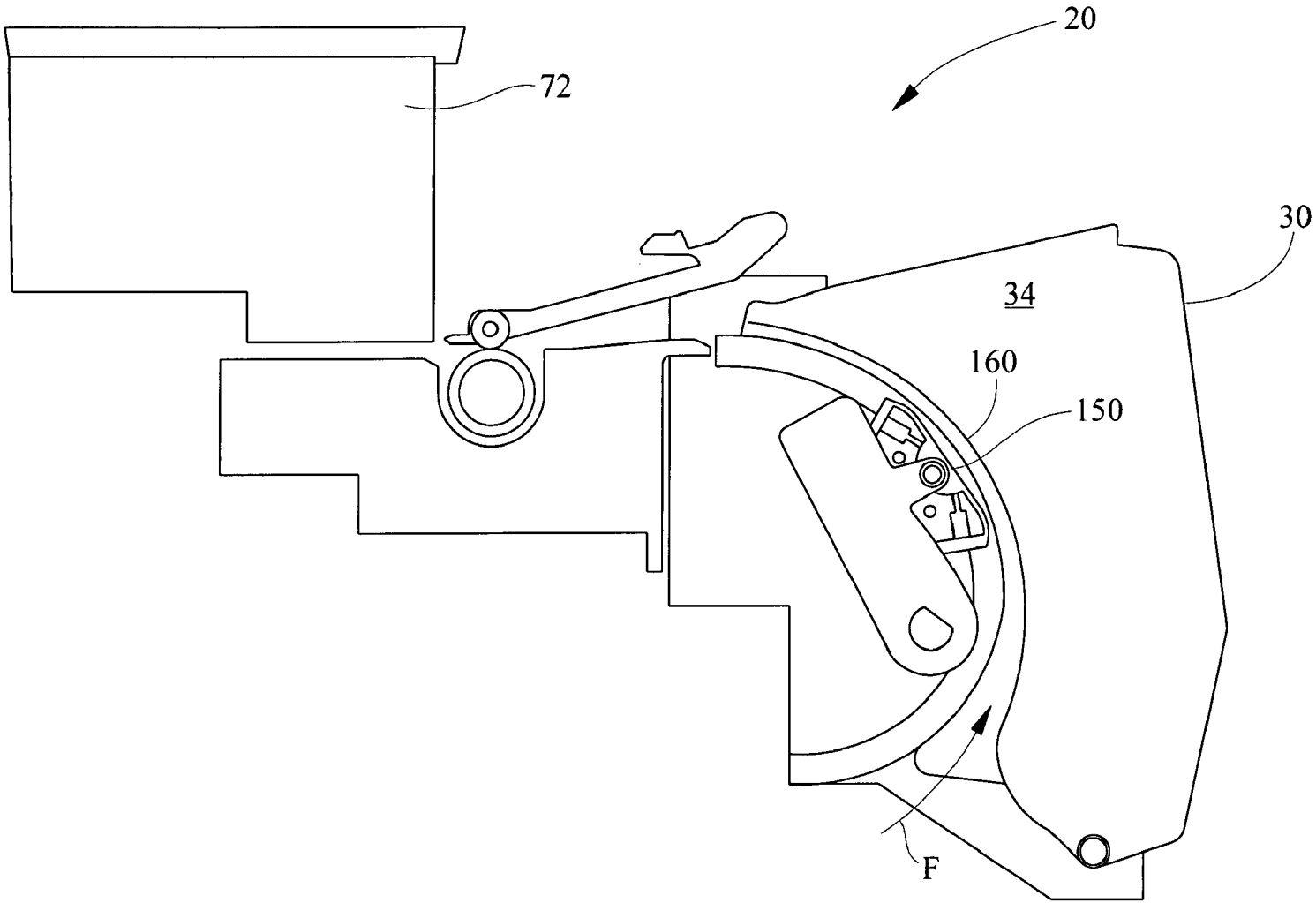
FIG. 10 is a side view of an alternative embodiment of the C-path media feed wherein a sensor is mounted on the inner guide and a reflective surface is moveable with the outer guide and jam-door.

Referring now to FIG. 10, an alternative embodiment is depicted. According to the alternative embodiment, a sensor 150 is mounted along the inner feed path portion 26 and may be stationary or may rotate within the inner feed path portion 26. A reflective surface 160 is positioned on the jam-door 30. As the jam-door 30 is opened, the optical communication is broken between the sensor 150 and reflective surface 160. According to this embodiment, the reflective surface 160 may be defined by the outer guide 34 or a reflective coating or sticker disposed thereon opposite the sensor 150.

Figure 11:
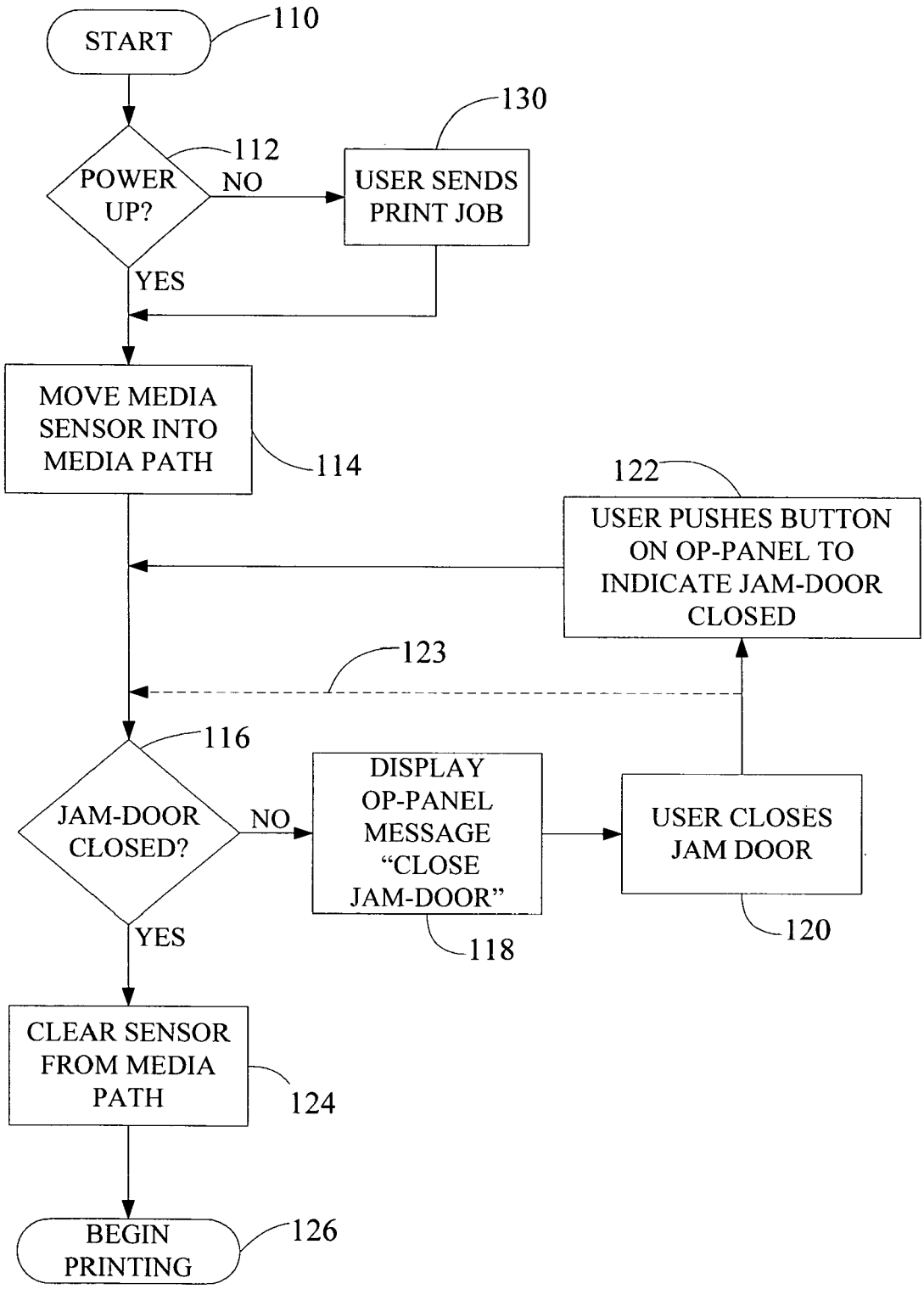
FIG. 11 is a flow chart of a method of utilizing the present invention.

Referring now to FIG. 11, a flow chart depicts two methods which may be utilized alone or in combination with the present invention. In operation, the open jam-door sensing generally occurs during power-up and during a ready-state condition each time a print job is sent to the device 10. According to the first method, in order to start the sequence at 110, the peripheral device 10 determines at 112 whether the device is beginning a power-up sequence or whether the peripheral has previously been powered-up and is already in a ready-state condition. If the query at 112 determines that the peripheral is in a power-up sequence, the media sensor is moved into the media path at 114 by a reverse or second rotation of the pick motor wherein the sensor 50 advances through window 38 adjacent to or in contact with the inner guide 26 to a position shown in FIG. 5, for querying whether the jam door is closed at 116. In order to check the jam-door status at 116, the LED source 52 emits a light which is reflected from the inner guide 26 or the reflective sticker, coating or the like 60 and is received by the detector 54. The detector 54 measures the reflected light intensity. Next the LED source 52 is turned off and the detector 54 takes a second measurement. Mathematically, the second intensity can be subtracted from the first signal in order to account or compensate for any extra light infiltrating the housing 24. If the differential intensity is determined to be within a preselected range, the print processor determines that the jam-door 30 is closed, as shown in FIG. 3, and ready for printing. Next, to prepare for printing, the sensor 50 is cleared from the media path at 124 by rotating the pick motor in a first direction and the peripheral 10 can begin printing at 126 if a document is sent.

Alternatively, if at 116 the jam-door 30 is determined to be open wherein no or minimal signal or light intensity is received by the detector 54, the print controller is signaled accordingly and the operator control panel 14 displays an error message such as "Close Jam-door" at 118. Next, the user must close the jam-door at 120. At this point at 122, the user can push a button on the operator control panel to indicate that the jam-door has been closed. Alternatively, the firmware on the peripheral can automatically loop back at 123 to requery at 116 whether the jam-door 30 has been closed. At this point, if the processor determines that the jam-door 30 has been closed, the sensor 50 is cleared from the media feed path at 124 and printing may begin at 126. In a further embodiment, not shown in FIG. 11, additional steps can be performed to determine if the media sensor is malfunctioning. For example, if the user has closed the door at 120 but the requery at 116 indicates that the jam-door 30 is open, the user may deduce that the sensor 50 is malfunctioning. Next, the user may push a button on control panel 14 to override the sensor 50 forcing the processor to clear the sensor from the media path at 124 and begin printing at 126 if a document is sent to the peripheral 10.

As previously indicated a second method of use is also depicted in FIG. 11. According to the second method of use, the open jam-door sensing can also occur from a ready-state condition after the device 10 has been powered up at 112 and before a print job is sent. In the situation when the peripheral 10 has been powered on for some period of time prior to a user's decision to print, the peripheral has already gone through the aforementioned open jam door sensing during the initial power-up at 112. However, it is realized that the jam-door 30 may be opened after the power-up sensing but before printing. Accordingly, the second method of use allows the peripheral 10 to sense an open jam-door 30 after power-up and before printing a job. In this method, when the peripheral queries whether the device is being powered on at 112, the answer is no since the device has been powered-up for some period of time. When the processor determines that the device is not being powered on initially, the user sends the print job at 130. From this step forward the open jam-door sensing acts as previously described in the first embodiment so that the media sensor is moved at 114 to query whether the jam door is closed. If the query at 116 determines that the jam door 30 is open, the firmware loops back as previously indicated. If the jam-door is closed, then the sensor 50 is cleared from the feed path at 124 and printing begins at 126. According to the second method, if the sensor determines that the jam-door 30 is open, in addition to sending a message to the control panel 14, a message can also be sent to the user's PC flashing a message on the monitor or display so that the user may correct the situation. Once the condition is determined to be corrected by the sensor 50, the sensor 50 is cleared from the feed path at 124 and printing begins at 126. Thus, it should be clear upon reading of this description that the present invention utilizes at least two methods of jam-door sensing. The first method comprises sensing an open jam-door 30 during a power-up sequence and the second method comprises sensing an open jam-door 30 each time a printing sequence is started.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A multi-function peripheral device, comprising:

a feed path;

said feed path defined by an inner guide and an outer guide, said outer guide being connected to a peripheral housing of said peripheral device and movable between an open position and a closed position with respect to said inner guide; and a media sensor connected to one of said inner guide and said outer guide said media sensor transmitting a signal and sensing a reflected signal capable of indicating a type of media from each of a plurality of distinct types of media in said feed path and the position of said outer guide.

2. The multi-function peripheral device of claim 1 further comprising a jam-door connected to said peripheral housing and a reflective portion disposed opposite said media sensor, wherein the connection of said jam-door to said peripheral housing further comprises being selected from a pivotal connection and a detachable connection, wherein said outer guide is defined by the inner surface of said jam-door.

3. The multi-function peripheral device of claim 2 wherein the media sensor is also capable of indicating in a signal transmitted thereby whether said jam-door is opened.

4. The multi-function peripheral device of claim 2 wherein said reflective portion further comprises a reflective sticker.

5. The multi-function peripheral device of claim 2 further comprising said media sensor mounted on said outer guide and said reflective portion comprises an inner guide surface opposite said media sensor.

6. The multi-function peripheral device of claim 1 further comprising a processor and said media sensor signaling said processor when said outer guide is in the open position and signaling said processor of the type of media present when said outer guide is in the closed position.

7. The multi-function peripheral device of claim 1 further comprising:

the media sensor positioned on the outer guide and pivotally connecting to a sensor arm;

the sensor arm connecting to a sensor arm shaft; and a pick motor rotatably connecting to the sensor arm shaft wherein rotation of the pick motor in a first direction moves the media sensor away from the inner guide and rotation of the pick motor in a second direction moves the media sensor toward the inner guide.

8. The multi-function peripheral device of claim 7, wherein the sensor arm selectively pivots about the sensor arm shaft.

9. The multi-function peripheral device of claim 2, wherein the media sensor is capable of pivoting about two distinct axes relative to the housing.

10. A multi-function peripheral device, comprising:

an input paper tray;

a feed path extending from said input tray to an output tray and defined by a feed path inner guide and a feed path outer guide;

a jam-door pivotally mounted to a peripheral housing of said peripheral device to move between an open position and a closed position with respect to said feed path inner guide with said jam-door having said feed path outer guide extending therefrom;

a sensor pivotally mounted for movement into and out of said feed path;

a reflective surface opposite said sensor and in optical communication with said media sensor; and a controller with said media sensor in electrical communication with said controller, said controller inhibiting imaging operation of said peripheral device when said media sensor senses the jam-door in the open position based upon at least one signal received from the sensor.

11. The multi-function peripheral device of claim 10 wherein said media sensor is mounted on one of said feed path outer guide and feed path inner guides and said reflective surface is disposed on the other of said guides.

12. The multi-function peripheral device of claim 11 wherein said reflective surface being one of a guide surface opposite said media sensor and a reflective sticker mounted on said guide surface.

13. The multi-function peripheral device of claim 10 further comprising:

the media sensor positioned on the outer guide and pivotally connecting to a sensor arm;

the sensor arm connecting to a sensor arm shaft; and a pick motor rotatably connecting to the sensor arm shaft wherein rotation of the pick motor in a first direction moves the media sensor out of the feed path and rotation of the pick motor in a second direction moves the media sensor into the feed path.

14. The multi-function peripheral device of claim 13, wherein the sensor arm selectively pivots about the sensor arm shaft.

15. The multi-function peripheral device of claim 10, wherein the controller further determines a type of media in the imaging device from any of a plurality of distinct types of media, based upon one or more signals received from the sensor.

16. The multi-function peripheral device of claim 10, wherein the sensor is pivotally mounted along two distinct axes relative to the feed path.

17. In a printing device having a sensor positioned proximate a C-shaped feed path formed by an inner guide and an outer guide with said outer guide being formed on the inner surface of a jam-door pivotally mounted on said printing device and movable between an open position and a closed position with respect to the feed path, a method of detecting a state of the printing device, comprising:

emitting a light from said media sensor directed at one of said inner guide and said outer guide;

detecting a first light intensity when said sensor is on; and determining whether said jam-door is in one of the open position and the closed position by determining whether the detected first light intensity is within a preselected intensity range, and detecting a second light intensity without emitting a light from said sensor.

18. The method of claim 17 further comprising taking a differential intensity between said detected first light intensity and said second light intensity.

19. The method of claim 18 further comprising comparing said differential intensity to a pre-determined intensity range and based on said comparison determining the position of said jam-door.

20. The method of claim 17, further comprising moving, prior to emitting light, the sensor relative to the feed path.

21. The method of claim 20, wherein the moving comprises moving the sensor about a plurality of axes for positioning the sensor relative to the feed path.

22. In a multi-function peripheral device having a sensor positioned proximate a feed path formed by an inner guide and an outer guide, said outer guide being formed on the inner surface of a jam-door pivotally mounted on said printing device and movable between an open position and a closed position with respect to the feed path, and a pick motor rotatably connected to said media sensor, a method of detecting a state of the peripheral device, comprising:

powering on said peripheral device;

rotating said pick motor in at least one direction;

moving said sensor toward one of said inner guide and said outer guide with said rotation;

emitting a light from said sensor at one of said inner guide and said outer guide;

detecting a light intensity; and determining whether said detected light intensity is within a preselected intensity range indicating said jam-door is in the closed position.

23. The method of claim 22, further comprising upon determining the position of the jam-door, one of sending an error signal to a control panel when the jam-door is in the open position and beginning a print process when the jam-door is in the closed position.

24. The method of claim 22 further comprising detecting a second intensity without emitting a light from said sensor.

25. The method of claim 24 further comprising taking a differential intensity between said detected light intensity and said second intensity.

26. The method of claim 25 further comprising comparing said differential intensity to a pre-determined intensity range and based on said comparison determining the position of said jam-door.

27. The method of claim 22, wherein the moving comprises moving the sensor about a plurality of axes for positioning relative to one of the inner guide and the outer guide.

28. The method of claim 22, further comprising detecting a second light intensity and determining a type of media that is in the peripheral device from any of a plurality of distinct types of media.

* * * * *